US008759680B2

(12) United States Patent
Patel

(10) Patent No.: US 8,759,680 B2
(45) Date of Patent: Jun. 24, 2014

(54) TWISTED PAIR COMMUNICATIONS CABLE WITH SELECTIVE SEPARATION OF PAIRS

(75) Inventor: Mahesh Patel, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 283 days.

(21) Appl. No.: 13/300,887

(22) Filed: Nov. 21, 2011

(65) Prior Publication Data

US 2012/0125658 A1 May 24, 2012

Related U.S. Application Data

(60) Provisional application No. 61/415,983, filed on Nov. 22, 2010.

(51) Int. Cl.
*H01B 11/04* (2006.01)

(52) U.S. Cl.
USPC ..... 174/113 R

(58) Field of Classification Search
USPC ..... 174/113 R, 113 C
See application file for complete search history.

(56) References Cited

U.S. PATENT DOCUMENTS

| | | | | |
|---|---|---|---|---|
| 5,789,711 | A | 8/1998 | Gaeris et al. | |
| 5,969,295 | A | 10/1999 | Boucino et al. | |
| 6,150,612 | A | 11/2000 | Grandy et al. | |
| 6,248,954 | B1 | 6/2001 | Clark et al. | |
| 6,566,605 | B1 | 5/2003 | Prudhon | |
| 6,570,095 | B2 | 5/2003 | Clark et al. | |
| 7,154,043 | B2 | 12/2006 | Clark | |
| 2003/0106704 | A1 * | 6/2003 | Isley et al. | 174/113 R |
| 2008/0093106 | A1 * | 4/2008 | Lique et al. | 174/113 C |
| 2010/0181093 | A1 | 7/2010 | Wiekhorst | |

FOREIGN PATENT DOCUMENTS

EP 2 219 194 A1 8/2010

OTHER PUBLICATIONS

International Search Report and Written Opinion for PCT/US2011/061574 mailed Feb. 29, 2012.

* cited by examiner

*Primary Examiner* — Chau N Nguyen
(74) *Attorney, Agent, or Firm* — Myers Bigel Sibley & Sajovec, P.A.

(57) ABSTRACT

A communications cable includes: a cable jacket; first, second, third and fourth twisted pairs of insulated conductors positioned within the jacket, the first, second, third and fourth twisted pairs having, respectively, first, second, third and fourth twist lengths, wherein a first difference between the first and third twist lengths and a second difference between the second and fourth twist lengths are greater than the difference between the twist lengths of any other combination of twisted pairs, and wherein a third difference between the third twist length and the fourth twist length is greater than the difference between the twist lengths of any other combination of twisted pairs except for the first and second differences; and a separator positioned between the third and fourth pairs. There is no separator present between the first and second pairs, the second and third pairs, and the first and fourth pairs.

13 Claims, 2 Drawing Sheets

TWISTED PAIR COMMUNICATIONS CABLE WITH SELECTIVE SEPARATION OF PAIRS

RELATED APPLICATION

This application claims priority from U.S. Provisional Patent Application No. 61/415,983, filed Nov. 22, 2010, the disclosure of which is hereby incorporated herein in its entirety.

FIELD OF THE INVENTION

This invention is directed generally to communications cables, and more specifically to twisted pair communications cables.

BACKGROUND OF THE INVENTION

Pursuant to certain industry standards (e.g., the TIA/EIA-568-B.2-1 standard approved Jun. 20, 2002 by the Telecommunications Industry Association), each jack, plug and cable segment in a communications system may include a total of at least eight conductors that comprise four twisted differential pairs. The industry standards specify that, in at least the connection region where the contacts (blades) of a modular plug mate with the contacts of the modular jack (referred to herein as the "plug-jack mating region"), the eight contacts of the jack or plug are aligned in a row and are assigned specific pair numbers.

Local area network (LAN) cables may suffer from many transmission impairments. One such impairment is crosstalk between twisted pairs in a four-pair cable. "Crosstalk" in a communication system refers to unwanted signal energy that is induced onto the conductors of a first "victim" differential pair from a signal that is transmitted over a second "disturbing" differential pair. The induced crosstalk may include both near-end crosstalk (NEXT), which is the crosstalk measured at an input location corresponding to a source at the same location (i.e., crosstalk whose induced voltage signal travels in an opposite direction to that of an originating, disturbing signal in a different path), and far-end crosstalk (FEXT), which is the crosstalk measured at the output location corresponding to a source at the input location (i.e., crosstalk whose signal travels in the same direction as the disturbing signal in the different path). Both types of crosstalk comprise an undesirable noise signal that interferes with the information signal on the victim differential pair.

A variety of techniques may be used to reduce crosstalk in communications systems such as, for example, tightly twisting the paired conductors in a cable, whereby different pairs are twisted at different rates (also known as different "lay lengths") that are not harmonically related, so that each conductor in the cable picks up approximately equal amounts of signal energy from the two conductors of each of the other differential pairs included in the cable. If this condition can be maintained, then the crosstalk noise may be significantly reduced, as the conductors of each differential pair carry equal magnitude, but opposite phase signals such that the crosstalk added by the two conductors of a differential pair onto the other conductors in the cable tends to cancel out.

In addition, some prior cables have included separators which introduce physical barriers between pairs. These barriers serve to increase the distance between pairs and in turn reduce the amount of crosstalk between the six distinct combinations of pairs. The barrier ay also act as a shield, which may further reduce crosstalk. By way of example, FIG. 1*a* is a cross-sectional view of a four pair unshielded twisted pair (UTP) cable 20 with no separator. The conductor pairs of the cable 20 are identified with the labels 1, 2, 3 and 4 (for the purposes of this discussion, these pair labels are arbitrary and do not necessarily correspond to the pair designations for jacks and plugs under TIA/EIA-568-B.2-1). In the cable 20 of FIG. 1*a*, some crosstalk exists between all six different combinations of pairs: namely, between pairs 1-2, 1-3, 1-4, 2-3, 2-4 and 3-4.

FIG. 1*b* illustrates a cable 20' that includes a cruciform-shaped separator 30, which is used to increase the distance between all pairs 1-4, thereby resulting in improved crosstalk immunity. Such a separator 30 is typically formed of a polymeric material. An exemplary separator 30 of this type is described in U.S. Pat. No. 5,969,295 to Boucino et al., the disclosure of which is hereby incorporated herein by reference.

FIG. 1*c* illustrates a cable 20" in which a flat tape is used as a separator 30'. As can be seen in FIG. 1*c*, the tape 30' is arranged such that pairs 1 and 4 are located on one side of the tape 30' and pairs 2 and 3 are located on the other side of the tape 30'. As a result, the combinations of pairs 1-2, 1-3, 2-4 and 3-4 realize improved crosstalk immunity. An exemplary separator of this type is described in U.S. Pat. No. 6,570,095 to Clark et al., the disclosure of which is hereby incorporated herein in its entirety.

SUMMARY

As a first aspect, embodiments of the present invention are directed to a communications cable. The communications cable comprises: a cable jacket; first, second, third and fourth twisted pairs of insulated conductors positioned within the jacket, the first, second, third and fourth twisted pairs having, respectively, first, second, third and fourth twist lengths, wherein a first difference between the first and third twist lengths and a second difference between the second and fourth twist lengths are greater less than the difference between the twist lengths of any other combination of twisted pairs, and wherein a third difference between the third twist length and the fourth twist length is less than the difference between the twist lengths of any other combination of twisted pairs except for the first and second differences; and a separator positioned between the third and fourth pairs. There is substantially no separator present between the first and second pairs, the second and third pairs, and the first and fourth pairs. A cable of this configuration may provide adequate crosstalk performance while utilizing less material and experiencing improved burn performance over cables that include more robust separators.

As a second aspect, embodiments of the present invention are directed to a communications cable, comprising: a cable jacket having an inner diameter; first, second, third and fourth twisted pairs of insulated conductors positioned within the jacket, the first, second, third and fourth twisted pairs having, respectively, first, second, third and fourth twist lengths; and a separator positioned between the third and fourth pairs, the separator having a height that is between about 27 and 82 percent of the jacket inner diameter. There is substantially no separator present between the first and second pairs, the second and third pairs, and the first and fourth pairs.

As a third aspect, embodiments of the present invention are directed to a communications cable, comprising: a cable jacket; first, second, third and fourth twisted pairs of insulated conductors positioned within the jacket, the first, second, third and fourth twisted pairs having, respectively, first, second, third and fourth twist lengths, wherein a first difference between the first and third twist lengths and a second difference between the second and fourth twist lengths are less than the difference between the twist lengths of any other combination of twisted pairs, and wherein a third difference between the third twist length and the fourth twist length is less than the difference between the twist lengths of any other combination of twisted pairs except for the first and second differences; and a separator positioned between the third and fourth pairs. There is substantially no separator present between the first and second pairs, the second and third pairs, and the first and fourth pairs. The separator is positioned such that an edge thereof is located between the second and fourth pairs and between the first and third pairs. The first and third pairs are positioned diagonally from each other, and the second and fourth pairs are positioned diagonally from each other.

DETAILED DESCRIPTION

Figure 1A:
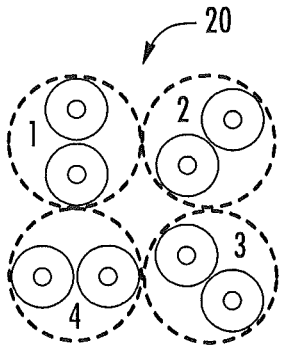
FIG. 1A (PRIOR ART)
FIG. 1*a* is a cross-sectional view of a known four-pair unshielded twisted pair cable with no separator between pairs.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" or "above" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "mounted" and the like can mean either direct or indirect attachment or contact between elements, unless stated otherwise.

Referring now to the figures, a cable, designated broadly at 100, is shown therein. The cable 100 includes four twisted pairs of insulated conductors 1, 2, 3, 4 of the variety discussed above. Such twisted pairs of conductors are well-known to those of skill in this art and need not be described in detail herein. In some embodiments, the conductor pairs 1-4 are twisted to different twist lengths, as doing so can aid in reducing crosstalk. There may also be some variation in twist length within a twisted pair; such variation is discussed in U.S. Pat. No. 7,392,647 to Hopkinson et al. the disclosure of which is hereby incorporated herein.

The cable 100 also includes a jacket 102, typically formed of a polymeric material, that surrounds the pairs 1, 2, 3, 4. Exemplary jacket materials are discussed in U.S. Pat. No. 5,969,295 to Boucino et al., supra.

Figure 1B:
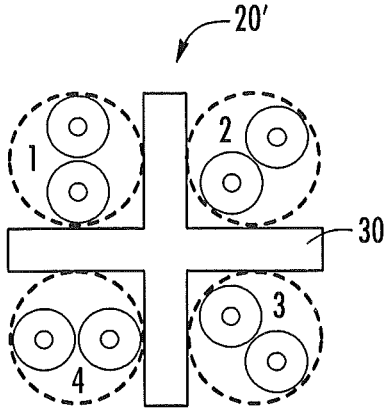
FIG. 1B (PRIOR ART)
FIG. 1*b* is a cross-sectional view of a known four-pair unshielded twisted pair cable with a cruciform-shaped separator between pairs.
Figure 1C:
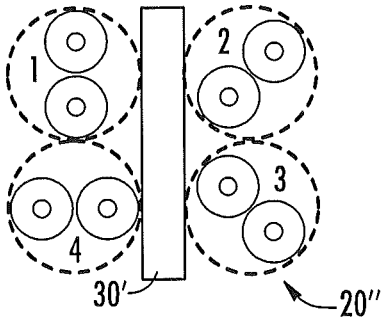
FIG. 1C (PRIOR ART)
FIG. 1*c* is a cross-sectional view of a known four-pair unshielded twisted pair cable with a flat separator that separates two pairs of the cable from the other two pairs of the cable.
Figure 2:
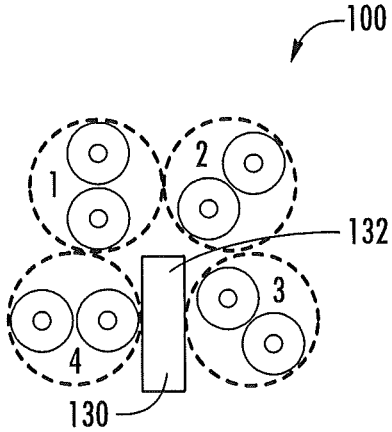
FIG. 2 is a cross-sectional view of a four-pair unshielded twisted pair cable with an abbreviated, tuned separator according to embodiments of the present invention.

As can be seen in FIG. 2, the cable 100 includes a separator 130 in the form of an abbreviated flat tape according to embodiments of the present invention. In FIG. 2, the separator 130 is shown positioned between conductor pairs 3 and 4; in this embodiment, there is no separator present between pairs 1 and 2, pairs 2 and 3, and pairs 1 and 4. Because the separator 130 is abbreviated in profile, it may require less material than a full flat tape such as that of FIG. 1, thereby resulting in cost savings and potentially better performance in burn testing. Also, the abbreviated profile of the separator 130 can enable the cable 100 to be produced in a smaller diameter than that of cables (such as cables 20' and 20" in FIGS. 1*b* and 1*c* above) that include a full tape or a cruciform-type separator.

The separator 130 is typically formed of a polymeric material, such as polyethylene, polypropylene or fluorinated polyethylene polypropylene (FEP). Exemplary materials are discussed in U.S. Pat. No. 5,969,295 to Boucino et al. and U.S. Pat. No. 6,570,095 to Clark et al., supra. The material used to form the separator 130 may be foamed, include perforations, or utilize other techniques known to reduce the amount of material in the separator 130. The separator 130 is typically between about 0.005 and 0.020 inches in thickness and about 0.05 and 0.15 inches in height (i.e., the dimension of the separator 130 that is parallel with the radial direction of the cable 100), but may vary depending on the dimensions of the cable 100. In some embodiments, the separator 130 has a height that is between about 27 and 82 percent of the inner diameter of the jacket 102.

Figure 3:
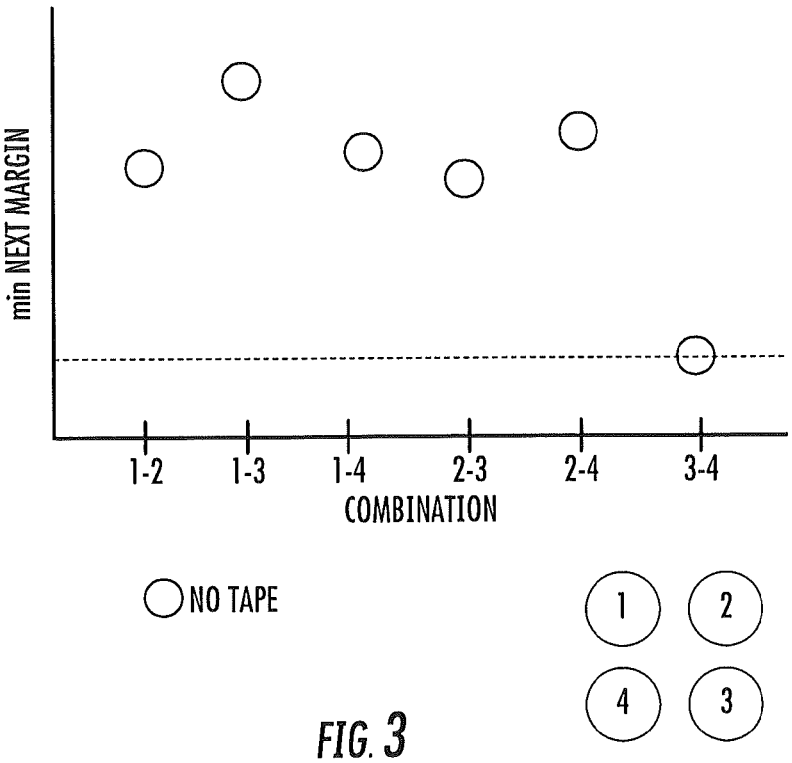
FIG. 3 is a theoretical graph plotting the NEXT margin between the six combinations of four twisted pairs in a cable with no separator present.
Figure 4:
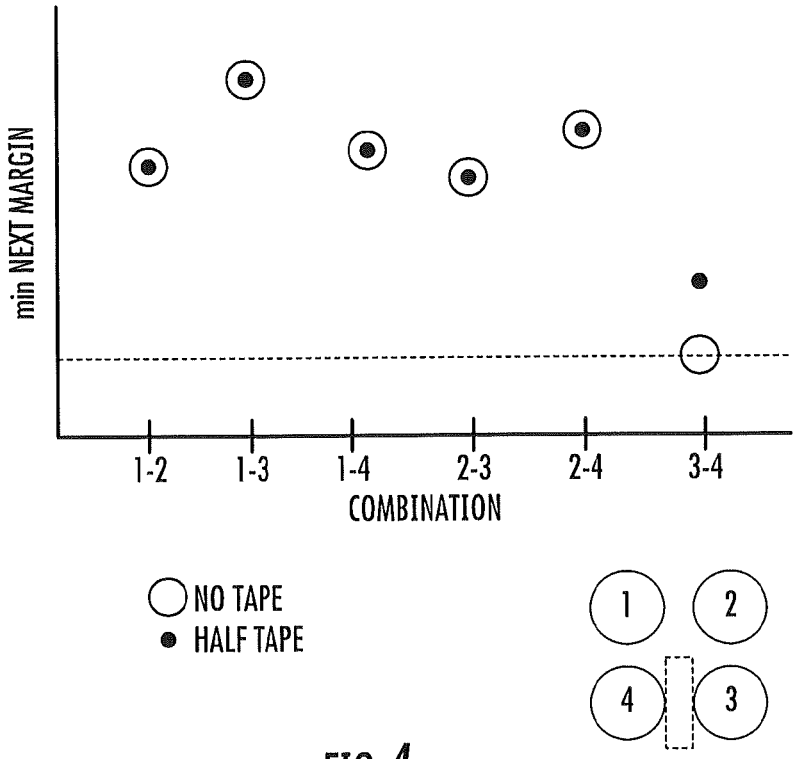
FIG. 4 is a theoretical graph plotting the NEXT margin between the six combinations of four twisted pairs in a cable with a separator present between pairs 3 and 4.

As noted above, in FIG. 2 the separator 130 is shown as being positioned between pairs 3 and 4, thereby improving crosstalk performance between these pairs. However, the separator 130 may be positioned such that it targets one of the most troublesome combination of pairs with respect to crosstalk. FIG. 3 is a theoretical graph plotting the NEXT margin between the six combinations of twisted pairs with no separator present (i.e., as with cable 20 of FIG. 1*a*). In FIG. 3, the lowest performing pair combination, pair combination 3-4, is considerably lower than the other pair combinations (and, as depicted in the graph of FIG. 3, borderline unacceptable). In contrast, FIG. 4 is a theoretical graph like that of FIG. 3 for the cable 100 having the separator 130 inserted between conductor pairs 3 and 4. As can be seen from the graph of FIG. 4, the insertion of a single abbreviated tape separator 130 between pairs 3 and 4 can raise the minimum NEXT margin, which raises the performance rating of the entire cable 100.

As can be seen in FIG. 2, the separator is positioned between pairs 3 and 4, but may be positioned between any combination of pairs that produces troublesome crosstalk. Generally speaking, in most instances the most troublesome crosstalk is generated by the pair combination with the smallest twist length difference, wherein the twist length difference is calculated by subtracting the twist lengths of two pairs. In some embodiments, the two pair combinations with the smallest twist length differences are placed "diagonally" from each other (e.g., pairs 1 and 3 are located diagonally from each other, as are pairs 2 and 4, in the cable of FIG. 2). This may reduce the amount of crosstalk between these pair combinations as compared to other pair combinations due to the increased separation along the diagonal. In such embodiments, the pair combination with the third smallest difference in twist length may be the pair combination separated by the abbreviated tape separator (e.g., pairs 3 and 4 in FIG. 2).

In addition, it can be seen in FIG. 2 that the upper edge 132 of the separator 130 is positioned such that it at least partially blocks a path between (a) pairs 1-3 and (b) pairs 2-4. Thus, the tape 132 can assist with curbing crosstalk between these diagonally located combinations of pairs also.

As a consequence of the use of an abbreviated profile separator such as the separator 130, each twisted pair of a cable can be positioned adjacent the pair or pairs that cause the fewest crosstalk issues and separated from the pairs that are most troublesome. In this manner, the cable can provide a more targeted solution for addressing crosstalk.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A communications cable, comprising:

a cable jacket;

first, second, third and fourth twisted pairs of insulated conductors positioned within the jacket, the first, second, third and fourth twisted pairs having, respectively, first, second, third and fourth twist lengths, wherein a first difference between the first and third twist lengths and a second difference between the second and fourth twist lengths are less than the difference between the twist lengths of any other combination of twisted pairs, and wherein a third difference between the third twist length and the fourth twist length is less than the difference between the twist lengths of any other combination of twisted pairs except for the first and second differences; and a separator positioned between the third and fourth pairs;

wherein there is substantially no separator present between the first and second pairs, the second and third pairs, and the first and fourth pairs;

wherein the separator is a substantially flat tape.

2. The communications cable defined in claim 1, wherein the separator is positioned such that an edge thereof is at least partially located between the second and fourth pairs and between the first and third pairs.

3. The communications cable defined in claim 1, wherein the first and third pairs are positioned diagonally from each other, and the second and fourth pairs are positioned diagonally from each other.

4. The communications cable defined in claim 1, wherein the separator comprises a material selected from the group consisting of: polyethylene, polypropylene and FEP.

5. The communications cable defined in claim 1, wherein the jacket has an inner diameter, and wherein the separator has a height dimension that is between about 27 and 82 percent of the jacket inner diameter.

6. A communications cable, comprising:

a cable jacket having an inner diameter;

first, second, third and fourth twisted pairs of insulated conductors positioned within the jacket, the first, second, third and fourth twisted pairs having, respectively, first, second, third and fourth twist lengths; and a separator positioned between the third and fourth pairs, the separator having a height that is between about 27 and 82 percent of the jacket inner diameter;

wherein there is no separator present between the first and second pairs, the second and third pairs, and the first and fourth pairs; and wherein the separator is positioned such that an edge thereof is at least partially located between the second and fourth pairs and between the first and third pairs.

7. The communications cable defined in claim 6, wherein a first difference between the first and third twist lengths and a second difference between the second and fourth twist lengths are less than the difference between the twist lengths of any other combination of twisted pairs, and wherein a third difference between the third twist length and the fourth twist length is less than the difference between the twist lengths of any other combination of twisted pairs except for the first and second differences.

8. The communications cable defined in claim 6, wherein the first and third pairs are positioned diagonally from each other, and the second and fourth pairs are positioned diagonally from each other.

9. The communications cable defined in claim 6, wherein the separator comprises a material selected from the group consisting of: polyethylene, polypropylene and FEP.

10. A communications cable, comprising:

a cable jacket;

first, second, third and fourth twisted pairs of insulated conductors positioned within the jacket, the first, second, third and fourth twisted pairs having, respectively, first, second, third and fourth twist lengths, wherein a first difference between the first and third twist lengths and a second difference between the second and fourth twist lengths are less than the difference between the twist lengths of any other combination of twisted pairs, and wherein a third difference between the third twist length and the fourth twist length is less than the difference between the twist lengths of any other combination of twisted pairs except for the first and second differences; and a separator positioned between the third and fourth pairs;

wherein there is substantially no separator present between the first and second pairs, the second and third pairs, and the first and fourth pairs; and wherein the separator is positioned such that an edge thereof is located between the second and fourth pairs and between the first and third pairs; and wherein the first and third pairs are positioned diagonally from each other, and the second and fourth pairs are positioned diagonally from each other.

11. The communications cable defined in claim 10, wherein the separator comprises a material selected from the group consisting of: polyethylene, polypropylene and FEP.

12. The communications cable defined in claim 10, wherein the separator is a substantially flat tape.

13. The communications cable defined in claim 10, wherein the jacket has an inner diameter, and wherein the separator has a height dimension that is between about 27 and 82 percent of the jacket inner diameter.

* * * * *

UNITED STATES PATENT AND TRADEMARK OFFICE

CERTIFICATE OF CORRECTION

PATENT NO. : 8,759,680 B2
APPLICATION NO. : 13/300887
DATED : June 24, 2014
INVENTOR(S) : Patel It is certified that error appears in the above-identified patent and that said Letters Patent is hereby corrected as shown below:

In the Specification:

Column 2, Line 37: Please correct "are greater less than"
to read -- are less than --

Signed and Sealed this
Second Day of December, 2014

Michelle K. Lee

Michelle K. Lee
*Deputy Director of the United States Patent and Trademark Office*